US009366271B2

(12) United States Patent
Tajima et al.

(10) Patent No.: US 9,366,271 B2
(45) Date of Patent: Jun. 14, 2016

(54) SLEWING TYPE CONSTRUCTION MACHINE

(71) Applicant: KOBELCO CONSTRUCTION MACHINERY CO., LTD., Hiroshima-shi (JP)

(72) Inventors: Kazuharu Tajima, Hiroshima (JP); Koji Ueda, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 264 days.

(21) Appl. No.: 14/105,942

(22) Filed: Dec. 13, 2013

(65) Prior Publication Data

US 2014/0190159 A1 Jul. 10, 2014

(30) Foreign Application Priority Data

Jan. 10, 2013 (JP) ..... 2013-002350

(51) Int. Cl.
*F15B 11/04* (2006.01)
*F15B 11/044* (2006.01)
*E02F 9/12* (2006.01)

(52) U.S. Cl.
CPC ..... *F15B 11/0445* (2013.01); *E02F 9/128* (2013.01); *F15B 11/0406* (2013.01); *F15B2211/329* (2013.01); *F15B 2211/50527* (2013.01); *F15B 2211/6316* (2013.01); *F15B 2211/6336* (2013.01); *F15B 2211/6355* (2013.01); *F15B 2211/7058* (2013.01); *F15B 2211/715* (2013.01); *F15B 2211/853* (2013.01)

(58) Field of Classification Search
CPC ..... F15B 11/0406; F15B 2211/715; F15B 2211/853; F15B 2211/7058; E02F 9/128
USPC ..... 60/435, 436
See application file for complete search history.

(56) References Cited

U.S. PATENT DOCUMENTS 6,266,594 B1 * 7/2001 Ishikawa ..... B60G 17/005 177/1
2011/0227512 A1 * 9/2011 Komiyama ..... B66C 23/86 318/369
2013/0243557 A1 * 9/2013 Hiroki ..... B60L 11/123 414/687

FOREIGN PATENT DOCUMENTS

JP 10-219749 A 8/1998
JP 2005-278327 A 10/2005
JP 2010-156136 A 7/2010
JP 2011-1736 A 1/2011
JP 2011-179280 9/2011

OTHER PUBLICATIONS

Office Action issued on Nov. 18, 2014 in Japanese Patent Application No. 2013-002350 with English Summary of the Office Action.

* cited by examiner

*Primary Examiner* — Nathaniel Wiehe
*Assistant Examiner* — Abiy Teka
(74) *Attorney, Agent, or Firm* — Oblon, McClelland, Maier & Neustadt, L.L.P.

(57) ABSTRACT

Provided is a slewing type construction machine including an upper slewing body and a slewing speed sensor that detects a slewing speed of the upper slewing body, enabling accurate control to be achieved regardless of an error in output from the slewing speed sensor. The construction machine includes an upper slewing body, a slewing motor, a hydraulic pump, a control valve, a slewing operation device, a slewing brake, a slewing speed sensor, a slewing operation detector that detects an operation applied to the slewing operation device, and a controller. The controller stores, during a slewing operation, a slewing speed detected by the slewing speed sensor at set time intervals, actuates the slewing brake based on a neutral return operation of the slewing operation device, and resets a stored value of the slewing speed that is stored during actuation of the slewing brake, to zero.

2 Claims, 3 Drawing Sheets

SLEWING TYPE CONSTRUCTION MACHINE

BACKGROUND OF THE INVENTION

1. Field of the Invention

The present invention relates to a slewing type construction machine such as a hydraulic excavator.

2. Description of the Related Art

Background art for the present invention will be described taking a hydraulic excavator shown in FIG. 3 as an example. The hydraulic excavator includes a crawler type lower traveling body 1, an upper slewing body 2 installed on the lower traveling body so as to be able to slew around an axis X perpendicular to a ground surface, and a front attachment 6 for excavation, the front attachment 6 attached to the upper slewing body 2. The front attachment 6 has a boom 3, an arm 4, and a bucket 5. Moreover, the hydraulic excavator includes a hydraulic slewing system for hydraulically slewing the upper slewing body 2. The system includes a slewing motor including a hydraulic motor and serving as a drive source, a control valve that controls operation of the slewing motor, right and left slewing conduit lines that connect the hydraulic motor to the control valve, a relief valve provided between the slewing conduit lines to serve as a brake valve, a remote control valve including an operation lever to which operations for slewing are applied, and a slewing brake that is a mechanical brake, i.e., what is called a parking brake. In the system, upon return of the operation lever to a neutral position, a supply of oil from a hydraulic pump to the slewing motor is stopped. Furthermore, the relief valve is opened, that is, relief actuation is performed to decelerate the slewing motor, and the slewing brake is actuated to keep the upper slewing body 2 stopped.

Moreover, various control operations are performed based on the hydraulic slewing system. For example, the slewing speed of the upper slewing body is detected by use of a slewing speed sensor. Based on the detected slewing speed, the actuation of the hydraulic slewing system is controlled. For example, Japanese Patent Application Laid-Open No. 2011-179280 discloses a technique of shifting to a constant speed operation when the detected slewing speed reaches a target speed determined from the operation amount of the remote control valve. Also a technique for controlling the discharge rate of the hydraulic pump in accordance with the slewing speed is known.

However, in connection with the characteristics of the slewing speed sensor, an offset (deviation from specifications) may occur in sensor output as a result of a change in temperature or the like. Specifically, a phenomenon may occur in which the sensor output fails to become zero even though the upper slewing body is stopped. Such a phenomenon may disadvantageously inhibit the slewing speed from being accurately detected, involving a problem of failing to intended control from being achieved or reducing control accuracy due to the use of erroneous sensor output.

SUMMARY OF THE INVENTION

An object of the present invention is to provide a slewing type construction machine including an upper slewing body and a slewing speed sensor that detects a slewing speed of the upper slewing body, the construction machine enabling accurate control to be achieved regardless of an error in output from the slewing speed sensor.

A construction machine provided by the present invention includes: a lower traveling body; an upper slewing body mounted on the lower traveling body so as to be able to be slewed; a slewing motor that is formed of a hydraulic motor and drives the upper slewing body to slew it; a hydraulic pump that discharges a hydraulic fluid for actuating the slewing motor; a control valve that is operated to control supply and discharge of the hydraulic fluid to and from the slewing motor; a slewing operation device to which an operation for the control valve is applied, the slewing operation device adapted to actuate the control valve in accordance with the operation; a slewing brake that operates to apply a brake force to the slewing motor to mechanically stop the upper slewing body and to keep the upper slewing body stopped, when a neutral return operation for stopping slewing of the upper slewing body is applied to the slewing operation device; a slewing speed sensor that detects a slewing speed of the upper slewing body to output a slewing speed signal; a slewing operation detector that detects an operation performed on the slewing operation device to output a slewing operation signal; and a controller to which signals from the slewing speed sensor and the slewing operation detector are input. The controller performs: (i) storing the slewing speed detected by the slewing speed sensor at set time intervals while a slewing operation for slewing the upper slewing body is applied to the slewing operation device, (ii) actuating the slewing brake according to the neutral return operation applied to the slewing operation device, and (iii) resetting a stored value of the slewing speed that is stored during actuation of the slewing brake, to zero.

DESCRIPTION OF THE PREFERRED EMBODIMENTS

Figure 2:
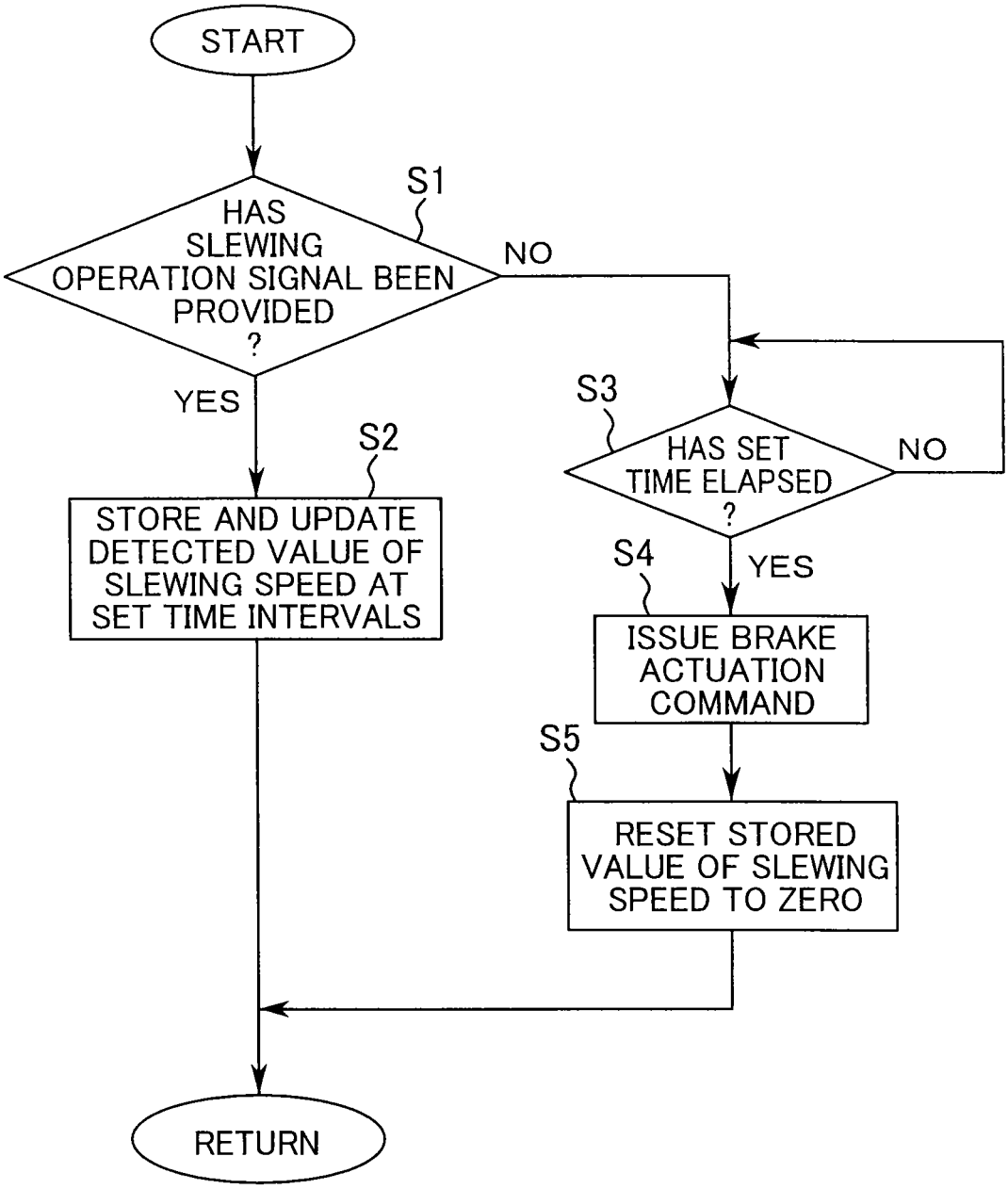
FIG. 2 is a flowchart for illustrating operation of the construction machine according to the embodiment.
Figure 3:
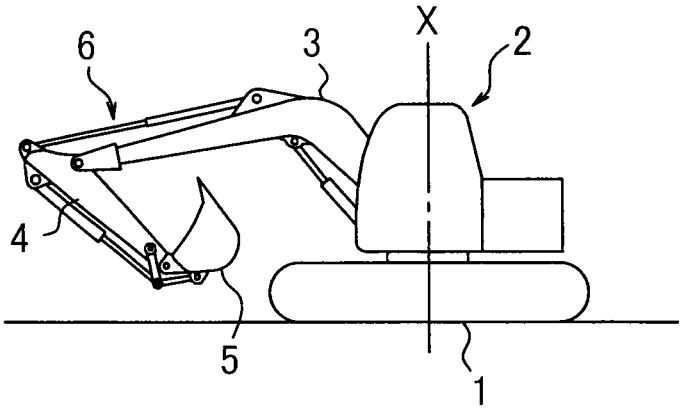
FIG. 3 is a schematic side view of a hydraulic excavator that is an example of the construction machine.

An embodiment of the present invention will be described with reference to FIG. 1 and FIG. 2. The embodiment is applied to such a hydraulic excavator as shown in, for example, FIG. 3, that is, a hydraulic excavator including a lower traveling body 1, an upper slewing body 2 installed on the lower traveling body so as to be able to slew, and a front attachment 6 for excavation attached to the upper slewing body 2.

Figure 1:
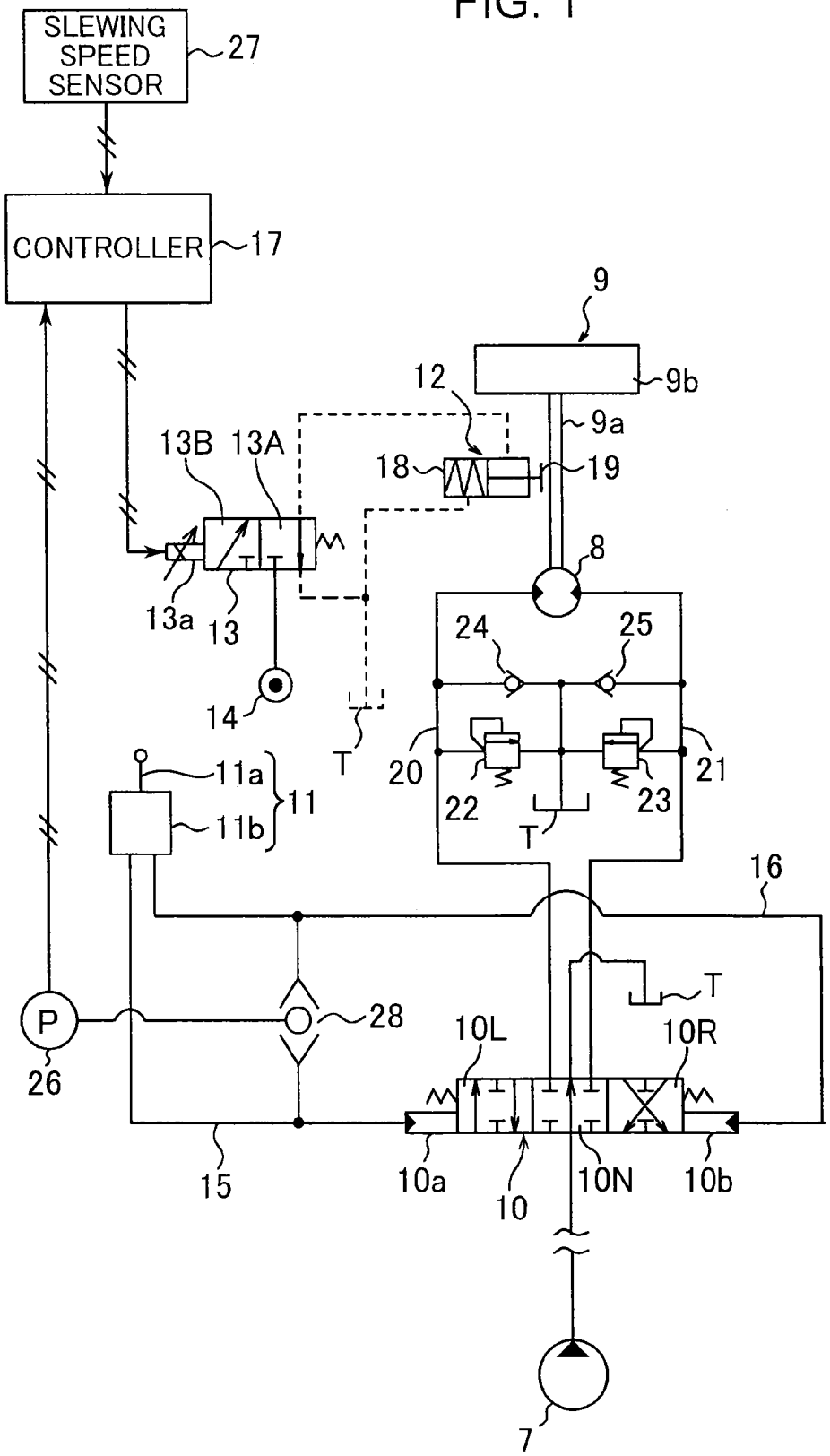
FIG. 1 is a diagram of configuration of a slewing system in a construction machine according to an embodiment of the present invention.

FIG. 1 shows a slewing system provided in the hydraulic excavator according to the embodiment to slew the upper slewing body. The slewing system includes a hydraulic pump 7 serving as a hydraulic source, a slewing motor 8 including a hydraulic motor that is rotated when supplied with a hydraulic fluid from the hydraulic pump 7, and a slewing drive device 9 that slews the upper slewing body 2 shown in FIG. 3 by means of power generated by the slewing motor 8. The slewing drive device 9 includes a motor shaft 9*a* and a slewing gear 9*b* both shown in FIG. 1. The motor shaft 9*a* is connected to an output shaft of the slewing motor 8.

The system further includes a control valve 10, a remote control valve 11, a slewing brake 12, a brake selector valve 13, a pilot pump 14, pilot lines 15 and 16 that are right and left slewing conduit lines, a controller 17, and a tank T.

The control valve 10 includes a hydraulic pilot selector valve with a pair of pilot ports 10*a* and 10*b*. The control valve 10 is provided between the hydraulic pump 7 and the slewing motor 8 to control supply and discharge of the hydraulic fluid to and from the slewing motor 8, that is, control switching between the rotation and stoppage of the slewing motor 8 and the rotating direction and speed of the slewing motor 8. Specifically, the slewing motor 8 has a pair of ports, which are connected to the control valve 10 by motor conduit lines 20 and 21, respectively.

The remote control valve 11 has an operation lever 11*a* and a valve main body 11*b*. Operations are applied to the operation lever 11*a* by an operator. The valve main body 11*b* outputs a pilot pressure for actuating the control valve 10 in accordance with an operation applied to the operation lever 11*a*.

The slewing brake 12 is a mechanical brake that applies a brake force to the slewing motor 8 to mechanically stop the upper slewing body 2 and keep the upper slewing body 2 stopped when the control valve 10 is brought into a neutral state by an operation of returning the operation lever 11*a* to a neutral position. The pilot pump 14 is a hydraulic source for actuating the slewing brake 12. The pilot pump 14 is also a hydraulic source for the pilot pressure output by the remote control valve 11. The brake selector valve 13 is provided between the slewing brake 12 and the pilot pump 14 to control actuation of the slewing brake 12.

The valve main body 11*b* of the remote control valve 11 has a pair of outlet ports through which the pilot pressure is output. These outlet ports are connected to pilot ports 10*a* and 10*b* of the control valve 10 via right and left slewing pilot lines 15 and 16, respectively. The valve main body 11*b* of the remote control valve 11 outputs no pilot pressure when no operation is applied to the operation lever 11*a* to keep the operation lever 11*a* at the neutral position. On the other hand, when an operation is applied to the operation lever 11*a*, the valve main body 11*b* inputs a pilot pressure corresponding to the direction and amount of the applied operation to the pilot port 10*a* or 10*b* through the pilot line 15 or 16. The control valve 10 has a neutral position 10N, a left slewing position 10L, and a right slewing position 10R. The control valve 10 is kept at the neutral position 10N when no pilot pressure is input to the pilot port 10*a* or 10*b*; the control valve 10 is switched to the left slewing position 10L or the right slewing position 10R in response to the pilot pressure when the pilot pressure is input to the pilot port 10*a* or 10*b*.

The brake selector valve 13 shown in FIG. 1 includes a solenoid operated selector valve with two positions. Specifically, the brake selector valve 13 has a solenoid 13*a* that receives an input electric signal, adapted to be switched between a brake actuation position 13A and a brake release position 13B depending on whether or not the electric signal has been input. In the brake actuation position 13A, the brake selector valve 13 permits a hydraulic pressure output by the pilot pump 14 to be supplied to the slewing brake 12. On the other hand, in the brake release position 13B, the brake selector valve 13 stops the supply of the hydraulic pressure to the slewing brake 12.

The controller 17 controls the switching operation of the brake selector valve 13 by inputting an electric signal to the solenoid 13*a* of the brake selector valve 13. Specifically, during a slewing operation, that is, while an operation is being applied to the operation lever 11*a* of the remote control valve 11, the controller 17 sets the brake selector valve 13 in the brake release position 13B. While slewing is stopped, that is, while no operation is being applied to the operation lever 11*a* of the remote control valve 11, the controller 17 sets the brake selector valve 13 in the brake actuation position 13A.

The slewing brake 12 has a brake cylinder 18 and a brake body 19. The brake cylinder 18 includes a telescopic hydraulic cylinder that performs a telescopic operation to switch between a brake actuation state and a brake release state. The brake body 19 is provided at a rod side end of the brake cylinder 18, and, during an extending operation of the brake cylinder 18, comes into contact with, for example, the motor shaft 9*a* of the slewing drive device 9 to apply a brake force to the slewing drive device 9.

The slewing brake 12 according to the embodiment is a negative brake that releases the brake only receiving the supply of a hydraulic pressure. Specifically, the brake cylinder 18 of the slewing brake 12 includes a built-in spring. The spring keeps the brake cylinder 18 extended, that is, keeps the brake cylinder 18 in the brake actuation state, while the hydraulic pressure is not supplied to the slewing brake 12. When the hydraulic pressure is supplied to the slewing brake 12, the brake cylinder 18 is contracted against the resilient force of the spring to release the brake.

The system further includes a pair of relief valves 22 and 23 and a pair of check valves 24 and 25. The relief valves 22 and 23 are provided between the tank T and the motor conduit lines 20 and 21, respectively, to serve as a brake valve. The check valves 24 and 25 are provided between the tank T and the motor conduit lines 20 and 21 to prevent possible cavitation.

In this system, when a neutral return operation is applied to the remote control valve 11 during slewing, that is, when the operation lever 11*a* of the remote control valve 11 is operated to return to the neutral position, the control valve 10 returns to the neutral position 10N to inhibit the supply of the hydraulic fluid to the slewing motor 8. At this time, the relief valve 22 or 23 is opened to perform relief actuation so as to effect deceleration, that is, to apply a hydraulic brake. The upper slewing body 2 is thereby decelerated while being slewed under inertia, finally stopped.

After the stoppage, theoretically, the upper slewing body 2 remains stopped by an action performed by the control valve 10 to block a channel for the hydraulic fluid for the slewing motor 8. This stop maintenance action is, however, unreliable because of leakage of the hydraulic fluid from the slewing motor 8 or the control valve 10; on a slope or the like, the upper slewing body 2 may start to move under the weight of the upper slewing body 2 even though the control valve 10 returns to the neutral state.

Hence, in order to reliably maintain the stop state, the controller 17 actuates the slewing brake 12, a mechanical brake, to apply a mechanical brake force to the slewing drive device 9. Specifically, after the remote control valve 11 returns to the neutral state, that is, after the operation lever 11*a* of the remote control valve 11 is returned to the neutral position, the controller 17 actuates the slewing brake 12 after a preset time elapses to achieve a reliable slewing stop action and a reliable stop maintenance action. As the preset time, given is a time need to reliably stop the slewing of the upper slewing body 2 by a hydraulic brake action performed by the control valve 10, from the point in time when the remote control valve 11 is returned to the neutral state. In other words, the upper slewing body 2 is normally in a substantial slewing stop state when the slewing brake 12 is actuated, and actuation timings for the slewing brake 12 are set to allow the slewing brake 12 to keep the upper slewing body 2 in the slewing stop state.

As means for implementing the above-described control, the hydraulic excavator according to the embodiment includes, in addition to the controller 17, an operation sensor 26 and a slewing speed sensor 27. The operation sensor 26 is a slewing operation detector that detects an operation applied to the remote control valve 11. In the embodiment, the operation sensor 26 is constituted by a pressure sensor that detects a pilot pressure applied to the control valve 10 by the remote control valve 11. Specifically, a shuttle valve 28 is provided between the pilot lines 15 and 16, and the operation sensor 26*a* detects the pressure selected by the shuttle valve 28, that is, a pilot pressure generated in one of the pilot lines 15 and 16. The slewing speed sensor 27 detects the slewing speed of the upper slewing body 2. The sensors 26 and 27 generates respective electric signals, namely, a slewing operation signal and a slewing speed signal, and inputs the signals to the controller 17.

The controller 17 judges, based on the slewing operation signal from the operation sensor 26, whether a slewing operation has been applied to the remote control valve 11, that is, the operation lever 11*a* of the remote control valve 11 has been moved from the neutral position to one of the opposite sides or has been returned to the neutral position, that is, the operation lever 11*a* is in the neutral position. When judging that a slewing operation is being applied, the controller 17 outputs an electric signal to switch the brake selector valve 13 to the brake release position 13B. On the other hand, when judging that the remote control valve 11 is returning to the neutral position, the controller 17 switches the brake selector valve 13 to the brake actuation position 13A a set time after the point in time of neutral return.

Moreover, the controller 17 according to the embodiment, based on the slewing speed detected by the slewing speed sensor 27, performs not only control of the discharge amount of the hydraulic pump 7 and various other control operations, but also zero-correction, automatically, on output from the slewing speed sensor 27 (hereinafter simply referred to as "sensor output") at every slewing stop. Specifically, the controller 17 stores the slewing speed detected by the slewing speed sensor 27 at preset time intervals while the operation levers 11*a* of the remote control valve 11 is being operated leftward or rightward for slewing. Then, when the remote control valve 11 is operated to return to the neutral state, the controller 17 issues a brake actuation command to the brake selector valve 13 when the set time elapses after the neutral return operation has been performed, and the controller 17 further resets the stored value of the slewing speed to "0" stored at the point in time of the brake actuation command.

This operation will be described in further detail with reference to the flowchart in FIG. 2. In step S1, the controller 17 judges whether or not a slewing operation signal has been provided by the remote control valve 11. If judging YES, the controller 17 stores and updates the detected value of the slewing speed from the slewing speed sensor 27 at the set time intervals, in step S2. If judging NO (no slewing operation signal exists) in step S1, the controller 17 makes a judgment in step S3, that is, judges whether or not a set time has elapsed since the loss of the slewing operation signal as a result of the return of the remote control valve 11 to the neutral state. Upon judging YES, that is, upon judging that the set time has elapsed, the controller 17 issues a brake actuation command to the brake selector valve 13 in step S4. Moreover, in step S5, the controller 17 resets the stored value (latest update value) of the slewing speed stored at the current point in time, that is, at the point in time when the brake actuation command is issued, to "0" regardless of the actual stored value. In other words, the controller 17 recognizes that the slewing speed is zero. Accordingly, when the next slewing operation is performed, the slewing speed detected by the slewing speed sensor 27 and recognized by the controller 17 starts from "0". In this manner, the "zero-correction" of the sensor output is automatically carried out for every slewing stop, and, based on the zero-corrected speed detected value, various control operations are performed such as the control of the pump discharge amount in accordance with the slewing speed.

Thus, on the assumption that the time of actuation of the slewing brake 12 coincides with the time of stop of the upper slewing body 2, the controller 17 stores the detected value of the slewing speed at time intervals before the actuation of the slewing brake 12 (during a slewing operation) and resets the stored value stored at the time of actuation of the slewing brake 12 to "0" regardless of the actual stored value, thereby being allowed to perform the automatic zero-correction of the sensor output for every slewing stop, that is, allowed to correct an offset error and the like in the slewing speed sensor 27.

In this embodiment, based on the assumption that, when the controller 17 outputs a brake actuation command, the upper slewing body 2 has already been brought into the slewing stop state by the hydraulic brake action, the stored value of the slewing speed at the point in time when the brake actuation command is issued is reset to "0"; the zero-correction is thus allowed to be more accurately carried out at the point in time when slewing is stopped. However, in the case where the characteristics of the slewing brake of the construction machine definitely indicate that the upper slewing body 2 stops slewing slightly before or after the point in time of the output of the brake actuation command, the stored value stored slightly before or after the output of the brake actuation command may be reset to "0". The "time of actuation of the slewing brake" according to the present invention is a concept including the above-described operations.

The present invention is not limited to the hydraulic excavator. The present invention is widely applicable to any other slewing type construction machine such as a dismantling machine which is configured utilizing base components of a hydraulic excavator.

As described above, the present invention provides a slewing type construction machine including an upper slewing body and a slewing speed sensor that detects a slewing speed of the upper slewing body, the construction machine enabling accurate control to be achieved regardless of an error in output from the slewing speed sensor. The construction machine includes: a lower traveling body; an upper slewing body mounted on the lower traveling body so as to be able to be slewed; a slewing motor that is formed of a hydraulic motor and drives the upper slewing body to slew it; a hydraulic pump that discharges a hydraulic fluid for actuating the slewing motor; a control valve that is operated to control supply and discharge of the hydraulic fluid to and from the slewing motor; a slewing operation device to which an operation for the control valve is applied, the slewing operation device adapted to actuate the control valve in accordance with the operation; a slewing brake that operates to apply a brake force to the slewing motor to mechanically stop the upper slewing body and to keep the upper slewing body stopped, when a neutral return operation for stopping slewing of the upper slewing body is applied to the slewing operation device; a slewing speed sensor that detects a slewing speed of the upper slewing body to output a slewing speed signal; a slewing operation detector that detects an operation performed on the slewing operation device to output a slewing operation signal; and a controller to which signals from the slewing speed sensor and the slewing operation detector are input. The controller performs: (i) storing the slewing speed detected by the slewing speed sensor at set time intervals while a slewing operation for slewing the upper slewing body is applied to the slewing operation device, (ii) actuating the slewing brake according to the neutral return operation applied to the slewing operation device, and (iii) resetting a stored value of the slewing speed that is stored during actuation of the slewing brake, to zero.

Thus, on the assumption that the time of actuation of the slewing brake coincides with the time of stop of the upper slewing body, the controller stores the detected value of the slewing speed at time intervals before the actuation of the slewing brake (during a slewing operation) and resets the stored value stored at the time of actuation of the slewing brake to "0" regardless of the actual stored value, thereby being enabled to make the automatic zero-correction of the sensor output for every slewing stop, that is, to correct an offset error and the like in the slewing speed sensor.

Specifically, it is desirable that: the construction machine further includes a pair of motor conduit lines for connecting the control valve to each of a pair of ports of the slewing motor and a relief valve provided between a tank and each of the motor conduit lines; the control valve is set in a neutral position when the slewing operation device returns to a neutral state, and stops feeding of the hydraulic fluid from the hydraulic pump to the slewing motor in the neutral position; the relief valve is opened by setting of the control valve in the neutral position, thus performing relief actuation to apply a hydraulic brake; and the controller issues a brake actuation command for actuating the slewing brake after a set time has elapsed since return of the slewing operation device to a neutral state, and resets a stored value of the slewing speed that is stored at a point in time of the brake actuation command, to zero. The reason for this configuration is as follows.

In an actual construction machine such as a hydraulic excavator, the slewing brake is actuated with the slewing speed reduced approximately to zero by a deceleration action performed by the relief valve, after the slewing operation device returns to the neutral state as described above. Specifically, control for actuating the slewing brake is performed at the point in time when a time preset equal to the time needed for deceleration following the neutral return elapses. In this case, the point in time when the controller issues the actuation command to the slewing brake normally coincides with the point in time when slewing of the upper slewing body is stopped. Accordingly, resetting the stored value of the slewing speed stored at the point in time when the actuation command is issued to the slewing brake to zero allows the zero-correction to be more accurately carried out at the point in time when the slewing is stopped.

This application is based on Japanese Patent application No. 2013-002350 filed in Japan Patent Office on Jan. 10, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A construction machine comprising:

a lower traveling body;

an upper slewing body mounted on the lower traveling body so as to be able to slew;

a slewing motor that is formed of a hydraulic motor, and drives the upper slewing body to slew the upper slewing body;

a hydraulic pump that discharges a hydraulic fluid for actuating the slewing motor;

a control valve that is operated to control supply and discharge of the hydraulic fluid to and from the slewing motor;

a slewing operation device to which an operation for the control valve is applied, the slewing operation device adapted to actuate the control valve in accordance with the operation;

a slewing brake that operates to apply a brake force to the slewing motor to mechanically stop the upper slewing body and to keep the upper slewing body stopped, when a neutral return operation for stopping slewing of the upper slewing body is applied to the slewing operation device;

a slewing speed sensor that detects a slewing speed of the upper slewing body to output a slewing speed signal;

a slewing operation detector that detects an operation applied to the slewing operation device to output a slewing operation signal; and a controller to which signals from the slewing speed sensor and the slewing operation detector are input, the controller adapted to perform (i) storing a value of the slewing speed detected by the slewing speed sensor at set time intervals while a slewing operation for slewing the upper slewing body is applied to the slewing operation device, (ii) actuating the slewing brake after a preset time elapses from a point in time of the neutral return operation of the slewing operation device, (iii) resetting the stored value of the slewing speed that is stored during actuation of the slewing brake, to zero to recognize that the value of the slewing speed detected by the slewing speed sensor is zero, and (iv) making the recognized value of the slewing speed start from zero when the next slewing operation is performed.

2. The construction machine according to claim 1, further comprising:

a pair of motor conduit lines for connecting the control valve to each of a pair of ports of the slewing motor; and a relief valve provided between a tank and each of the motor conduit lines, wherein:

the control valve is set in a neutral position when the slewing operation device returns to a neutral state, and stops feeding of the hydraulic fluid from the hydraulic pump to the slewing motor in the neutral position; the relief valve is opened by setting of the control valve in the neutral position, thus performing relief actuation to apply a hydraulic brake to the slewing motor; and the controller issues a brake actuation command for actuating the slewing brake after a set time has elapsed since return of the slewing operation device to a neutral state, and resets a stored value of the slewing speed that is stored at a point in time of the brake actuation command, to zero.

* * * * *